US012674326B2

(12) United States Patent
Chin

(10) Patent No.: US 12,674,326 B2
(45) Date of Patent: Jul. 7, 2026

(54) INSERT FOR A PITCH POCKET, A PITCH POCKET SYSTEM AND KIT, AND A METHOD OF INSTALLING A PITCH POCKET SYSTEM

(71) Applicant: BMIC LLC, Dallas, TX (US)

(72) Inventor: Norman Chin, Somerville, NJ (US)

(73) Assignee: BMIC LLC, Dallas, TX (US)

( * ) Notice: Subject to any disclaimer, the term of this patent is extended or adjusted under 35 U.S.C. 154(b) by 162 days.

(21) Appl. No.: 18/660,549

(22) Filed: May 10, 2024

(65) Prior Publication Data

US 2024/0376717 A1 Nov. 14, 2024

Related U.S. Application Data

(60) Provisional application No. 63/501,782, filed on May 12, 2023.

(51) Int. Cl.
*E04D 13/147* (2006.01)

(52) U.S. Cl.
CPC ..... *E04D 13/1476* (2013.01)

(58) Field of Classification Search
CPC ..... E04D 13/1476
USPC ..... 52/58
See application file for complete search history.

(56) References Cited

U.S. PATENT DOCUMENTS

| | | | |
|---|---|---|---|
| 957,980 | A | 5/1910 | Mikesell |
| 1,411,352 | A | 4/1922 | Hawksworth |
| 1,762,896 | A | 6/1930 | Sherlock |
| 2,226,354 | A | 12/1940 | Barr |
| 2,800,850 | A | 7/1957 | Mckann |
| 2,985,091 | A | 5/1961 | Hatcher |
| 3,838,544 | A | 10/1974 | Hindall |
| 4,333,660 | A | 6/1982 | Cupit |
| 4,563,847 | A | 1/1986 | Hasty |
| 4,570,943 | A | 2/1986 | Houseman et al. |
| 4,635,409 | A | 1/1987 | Vandemore |
| 4,837,991 | A | 6/1989 | Shaw |

(Continued)

FOREIGN PATENT DOCUMENTS

| | | | |
|---|---|---|---|
| CA | 640736 | A | 5/1962 |
| GB | 1310003 | A | 3/1973 |
| WO | 85/04923 | A1 | 11/1985 |

OTHER PUBLICATIONS

Johns Manville: "Application Tips—Johns Manville One-Part Pourable Sealer", pp. 1-4, Retrieved from the Internet: URL: https://www.jm.com/content/dam/jm/global/en/commercial-roofing/brochures/RS-2377%20JM%20One-Part%20Pourable%20Sealant%20Application%20Tips.pdf/ [retrieved on Jul. 3, 2024].

(Continued)

*Primary Examiner* — Lindsay M Maguire
(74) *Attorney, Agent, or Firm* — Venable LLP

(57) ABSTRACT

This invention, in embodiments, relates to an insert for a pitch pocket, with the insert comprising a first insert portion having an opening, and a second insert portion having an opening, wherein the first insert portion is configured to be positioned adjacent to the second insert portion in the pitch pocket, such that the opening of the first insert portion is positioned adjacent to the opening of the second insert portion in order to form a larger opening configured to receive a roof penetration. This invention, in embodiments, further relates to a pitch pocket system, a pitch pocket kit, and a method for installing a pitch pocket around a roof penetration.

11 Claims, 5 Drawing Sheets

(56) References Cited

U.S. PATENT DOCUMENTS

| | | | | |
|---|---|---|---|---|
| 4,903,997 | A | 2/1990 | Kifer | |
| 4,928,443 | A | 5/1990 | Goodman et al. | |
| 4,934,117 | A | 6/1990 | Barksdale | |
| 4,937,991 | A | 7/1990 | Orth | |
| 5,018,748 | A | 5/1991 | Schalle | |
| 5,309,579 | A | 5/1994 | Nelson | |
| 5,493,827 | A | 2/1996 | Georgeau et al. | |
| 5,518,277 | A | 5/1996 | Sanders | |
| 5,588,267 | A | 12/1996 | Rodriguez et al. | |
| 5,605,019 | A | 2/1997 | Maziekien et al. | |
| 5,768,838 | A | 6/1998 | Georgeau | |
| 5,899,034 | A | 5/1999 | Vermilion et al. | |
| 6,021,620 | A | 2/2000 | Vermilion et al. | |
| 6,640,503 | B1 * | 11/2003 | Evensen | E04D 13/1407 52/60 |
| 6,691,473 | B1 | 2/2004 | Mayle et al. | |
| 6,848,220 | B2 | 2/2005 | Faurholdt et al. | |
| 6,892,499 | B1 | 5/2005 | Mayle | |
| 6,892,782 | B1 | 5/2005 | Mayle | |
| 6,941,713 | B2 | 9/2005 | Williams | |
| 7,387,149 | B1 | 6/2008 | Mayle | |
| 7,762,024 | B1 | 7/2010 | Resech | |
| 2003/0014926 | A1 | 1/2003 | Champa et al. | |
| 2005/0028456 | A1 | 2/2005 | McLane et al. | |
| 2005/0172569 | A1 | 8/2005 | Jutras | |
| 2007/0272341 | A1 | 11/2007 | Khan et al. | |
| 2008/0085336 | A1 | 4/2008 | Mayle | |
| 2010/0109318 | A1 * | 5/2010 | Mulligan | E04D 13/0409 428/596 |
| 2015/0315413 | A1 | 11/2015 | Diggins | |

OTHER PUBLICATIONS

Duro-Last: "Duro-Last® Pitch Pan Filler", Jan. 1, 2009 (Jan. 1, 2009), Retrieved from the Internet: URL: https://www.reflectiveroofingrestoration.com/pdf/PRODUCT%20DATA%20SHEETS/CAULKMASTICAND%20PITCH%20POCKET%20FILLER/Pitch_Pan_Filler.pdf/ [retrieved on Jul. 3, 2024].

Versico Roofing Systems, product information sheet, © 2008 Versico, LLC.

The Pate Company, Patecurbs Product Catalog © 1996-2008.

GAF EverGuard Extreme Advanced Protection TPO Accessory for a Pourable Sealer Pocket, copyright Dec. 2014.

* cited by examiner

INSERT FOR A PITCH POCKET, A PITCH POCKET SYSTEM AND KIT, AND A METHOD OF INSTALLING A PITCH POCKET SYSTEM

This application claims the priority of U.S. provisional application Ser. No. U.S. 63/501,782 entitled "An Insert for a Pitch Pocket, a Pitch Pocket System and Kit, and a Method of Installing a Pitch Pocket System" filed May 12, 2023, which is incorporated herein by reference in its entirety for all purposes.

FIELD OF THE INVENTION

This invention relates to an insert for a pitch pocket, a pitch pocket system and kit, and a method of installing a pitch pocket system. A pitch pocket system is provided that includes an insert for a pitch pocket to promote a faster and easier method of installing the pitch pocket onto a roof.

BACKGROUND OF THE INVENTION

Currently, customers and/or commercial roof contractors use pourable sealant and/or various types of fill materials (e.g., granules, sand, rags, gravel, scrap pieces of polyisocyanurate (ISO) panels, and/or garbage), to reduce the amount of pourable sealant needed to seal a pitch pocket when installing the pitch pocket on a roof. The use of such unconventional fill materials, however, increases the potential failure of the pitch pocket (e.g., leakage, formation of cracks in the cured sealant, and/or possible incompatibility between the fill materials and the cured sealant). There is thus a need for an insert for a pitch pocket that will shorten the time needed to install the pitch pocket and/or cure the pourable sealant, while also eliminating potential incompatibility issues (e.g., between any fill material and the pourable sealant) and the possible cracking of the cured sealant, which can create a leak issue.

SUMMARY OF THE INVENTION

One embodiment of this invention pertains to an insert for a pitch pocket, with the insert comprising a first insert portion having an opening, and a second insert portion having an opening, wherein the first insert portion is configured to be positioned adjacent to the second insert portion in the pitch pocket, such that the opening of the first insert portion is positioned adjacent to the opening of the second insert portion in order to form a larger opening configured to receive a roof penetration.

In one embodiment, the first insert portion and the second insert portion comprise a lightweight fully dried concrete material.

In one embodiment, the first insert portion and the second insert portion comprise a material receptive to a pourable sealant.

In one embodiment, (i) the opening of the first insert portion is from 4 inches to 6 inches in diameter, and (ii) the opening of the second insert portion is from 4 inches to 6 inches in diameter. In one embodiment, (i) the opening of the first insert portion is from 4 15/16 inches to 5 1/16 inches in diameter, and (ii) the opening of the second insert portion is from 4 15/16 inches to 5 1/16 inches in diameter. In one embodiment, (i) the opening of the first insert portion is 4 3/8 inches in diameter, and (ii) the opening of the second insert portion is 4 3/8 inches in diameter.

In one embodiment, the first insert portion and the second insert portion are configured to fill the pitch pocket to a first height. In one embodiment, the first height is from 2 inches to 3 inches from a top edge of the pitch pocket. In one embodiment, the first height is from 2 3/8 inches to 2 5/8 inches from a top edge of the pitch pocket. In one embodiment, the first height is 2 1/2 inches from a top edge of the pitch pocket.

In one embodiment, the roof penetration comprises one of an electrical conduit, an electrical cable, a vent, a pipe, or a support member.

In one embodiment, the first insert portion is substantially the same size as the second insert portion.

Another embodiment of this invention pertains to a pitch pocket system comprising (a) a pitch pocket and (b) an insert positioned within the pitch pocket, wherein the insert comprises an opening configured to receive a roof penetration.

In one embodiment, the insert comprises a lightweight fully dried concrete material.

In one embodiment, the insert comprises a material receptive to a pourable sealant.

In one embodiment, the insert comprises at least one of a lightweight fully dried concrete material, a material receptive to a pourable sealant, or a combination thereof.

In one embodiment, the pitch pocket comprises thermoplastic polyolefin (e.g., a TPO membrane).

In one embodiment, the insert comprises (i) a first insert portion having an opening and (ii) a second insert portion having an opening.

In one embodiment, the opening of the insert is from 8 inches to 9 inches in diameter. In one embodiment, the opening of the insert is from 8 5/8 inches to 8 7/8 inches in diameter. In one embodiment, the opening of the insert is 8 3/4 inches in diameter.

In one embodiment, the insert fills the pitch pocket to a height that is from 2 inches to 3 inches from a top edge of the pitch pocket. In one embodiment, the insert fills the pitch pocket to a height that is from 2 3/8 inches to 2 5/8 inches from a top edge of the pitch pocket. In one embodiment, the insert fills the pitch pocket to a height that is 2 1/2 inches from a top edge of the pitch pocket.

In one embodiment, the roof penetration comprises one of an electrical conduit, an electrical cable, a vent, a pipe, or a support member.

Another embodiment pertains to a pitch pocket kit that includes (a) a pitch pocket, (b) a first insert portion having an opening, (c) a second insert portion having an opening, and (d) instructions for installation of the pitch pocket around a roof penetration, wherein the first insert portion is configured to be positioned adjacent to the second insert portion in the pitch pocket, such that the opening of the first insert portion is positioned adjacent to the opening of the second insert portion in order to form a larger opening configured to receive the roof penetration.

In one embodiment, the first insert portion and the second insert portion comprise a lightweight fully dried concrete material.

In one embodiment, the first insert portion and the second insert portion comprise a material receptive to a pourable sealant.

In one embodiment, the pitch pocket kit further comprises a pourable sealant. In one embodiment, the pourable sealant comprises a pourable TPO sealant.

In one embodiment, the pitch pocket comprises thermoplastic polyolefin (e.g., a TPO membrane).

In one embodiment, (i) the opening of the first insert portion is from 4 inches to 6 inches in diameter, and (ii) the opening of the second insert portion is from 4 inches to 6 inches in diameter. In one embodiment, (i) the opening of the first insert portion is from 4 15/16 inches to 5 1/16 inches in diameter, and (ii) the opening of the second insert portion is from 4 15/16 inches to 5 1/16 inches in diameter. In one embodiment, (i) the opening of the first insert portion is 4 3/8 inches in diameter, and (ii) the opening of the second insert portion is 4 3/8 inches in diameter.

In one embodiment, the first insert portion and the second insert portion are configured to fill the pitch pocket to a first height. In one embodiment, the first height is from 2 inches to 3 inches from a top edge of the pitch pocket. In one embodiment, the first height is from 2 3/8 inches to 2 5/8 inches from a top edge of the pitch pocket. In one embodiment, the first height is 2 1/2 inches from a top edge of the pitch pocket.

In one embodiment, the roof penetration comprises one of an electrical conduit, an electrical cable, a vent, a pipe, or a support member.

In one embodiment, the first insert portion is substantially the same size as the second insert portion.

Another embodiment of this invention pertains to a method for installing a pitch pocket around a roof penetration, with the method comprising (a) obtaining a pitch pocket, (b) obtaining a first insert portion having an opening, (c) obtaining a second insert portion having an opening, (d) positioning the pitch pocket around the roof penetration, (e) inserting the first insert portion and the second insert portion into the pitch pocket, such that the opening of the first insert portion is positioned adjacent to the opening of the second insert portion in order to form a larger opening that surrounds the roof penetration, and (f) pouring a sealant on top of the first insert portion and the second insert portion inserted into the pitch pocket to thereby seal the pitch pocket around the roof penetration.

In one embodiment, the first insert portion and the second insert portion comprise a lightweight fully dried concrete material.

In one embodiment, the first insert portion and the second insert portion comprise a material receptive to the sealant.

In one embodiment, the sealant comprises a pourable TPO sealant.

In one embodiment, the pitch pocket comprises thermoplastic polyolefin (e.g., a TPO membrane).

In one embodiment, (i) the opening of the first insert portion is from 4 inches to 6 inches in diameter, and (ii) the opening of the second insert portion is from 4 inches to 6 inches in diameter. In one embodiment, (i) the opening of the first insert portion is from 4 15/16 inches to 5 1/16 inches in diameter, and (ii) the opening of the second insert portion is from 4 15/16 inches to 5 1/16 inches in diameter. In one embodiment, (i) the opening of the first insert portion is 4 3/8 inches in diameter, and (ii) the opening of the second insert portion is 4 3/8 inches in diameter.

In one embodiment, the inserting of the first insert portion and the second insert portion is conducted to fill the pitch pocket to a height that is from 2 inches to 3 inches from a top edge of the pitch pocket. In one embodiment, the inserting of the first insert portion and the second insert portion is conducted to fill the pitch pocket to a height that is from 2 3/8 inches to 2 5/8 inches from a top edge of the pitch pocket. In one embodiment, the inserting of the first insert portion and the second insert portion is conducted to fill the pitch pocket to a height that is 2 1/2 inches from a top edge of the pitch pocket.

In one embodiment, the roof penetration comprises one of an electrical conduit, an electrical cable, a vent, a pipe, or a support member.

In one embodiment, the first insert portion is substantially the same size as the second insert portion.

BRIEF DESCRIPTION OF THE FIGURES

For a more complete understanding of the invention and the advantages thereof, reference is made to the following descriptions, taken in conjunction with the accompanying figures, in which.

DETAILED DESCRIPTION OF THE INVENTION

Figure 1A:
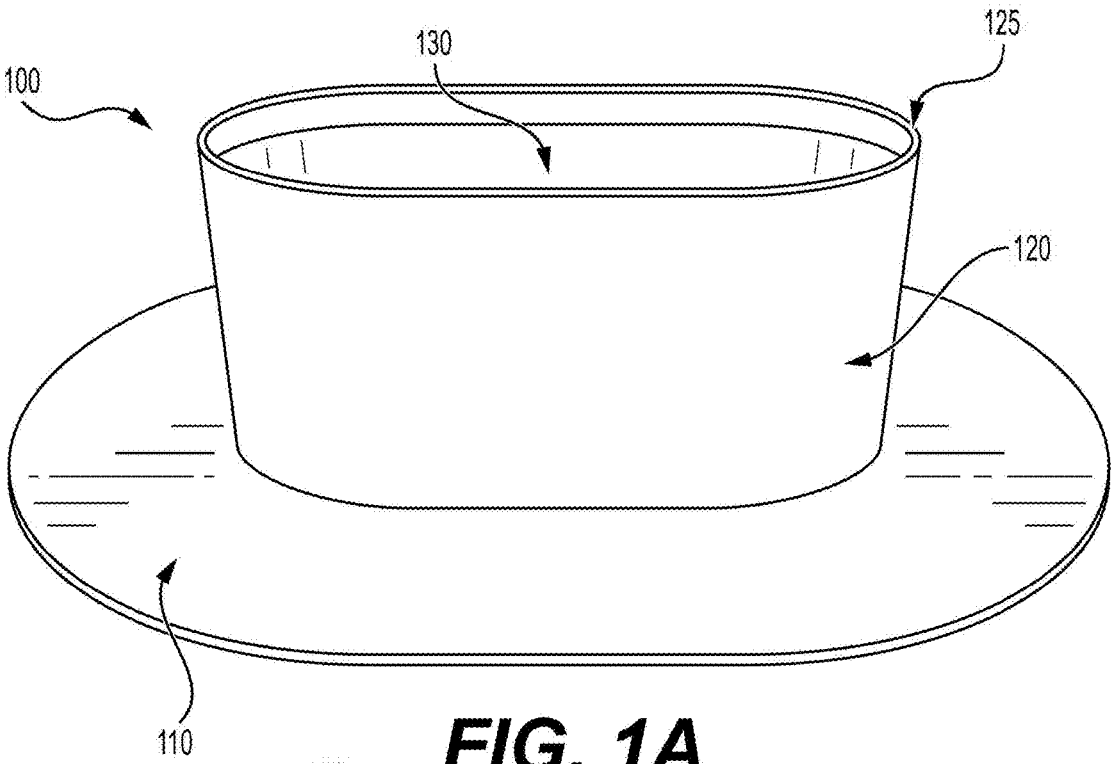
FIG. 1A is an illustration of a pitch pocket according to an embodiment of the invention.

Among those benefits and improvements that have been disclosed, other objects and advantages of this disclosure will become apparent from the following description taken in conjunction with the accompanying figures. Detailed embodiments of the present disclosure are disclosed herein; however, it is to be understood that the disclosed embodiments are merely illustrative of the disclosure that may be embodied in various forms. In addition, each of the examples given regarding the various embodiments of the disclosure are intended to be illustrative, and not restrictive.

Throughout the specification and claims, the following terms take the meanings explicitly associated herein, unless the context clearly dictates otherwise. The phrases "in one embodiment," "in an embodiment," and "in some embodiments" as used herein do not necessarily refer to the same embodiment(s), though they may. Furthermore, the phrases "in another embodiment" and "in some other embodiments" as used herein do not necessarily refer to a different embodiment, although they may. All embodiments of the disclosure are intended to be combinable without departing from the scope or spirit of the disclosure.

As used herein, the term "based on" is not exclusive and allows for being based on additional factors not described, unless the context clearly dictates otherwise. In addition, throughout the specification, the meaning of "a," "an," and "the" include plural references. The meaning of "in" includes "in" and "on."

As used herein, terms such as "comprising," "including," and "having" do not limit the scope of a specific claim to the materials or steps recited by the claim.

As used herein, terms such as "consisting of" and "composed of" limit the scope of a specific claim to the materials and steps recited by the claim.

All prior patents, publications, and test methods referenced herein are incorporated by reference in their entireties.

As used herein, the term "roofing surface" includes, but is not limited to, a roof deck or substrate, roof insulation, a roofing membrane, e.g., waterproofing membranes, underlayment, shingles, tiles, and combinations thereof.

As used herein, the term "TPO" means thermoplastic polyolefin.

Currently, customers and/or commercial roof contractors use pourable sealant and/or various types of fill materials (e.g., granules, sand, rags, gravel, scrap pieces of polyisocyanurate (ISO) panels, and/or garbage) to reduce the amount of pourable sealant needed to seal a pitch pocket when installing the pitch pocket on a roof or roof surface. The use of such unconventional fill materials, however, increases the potential failure of the pitch pocket (e.g., leakage, formation of cracks in the cured sealant, and/or possible incompatibility between the fill materials and the cured sealant). Moreover, the pourable sealant may not cure completely at the bottom of the pitch pocket due to the amount of pourable sealant needed to fill the pitch pocket and/or due to the inclusion of unconventional fill materials. For example, in some instances, only the top 1 inch to 1.5 inches of pourable sealant used to fill the pitch pocket actually cures, while the rest or the remainder of the pourable sealant within the pitch pocket does not cure.

Thus, the purpose of the current invention is to offer an insert for a pitch pocket that will shorten the time needed to install the pitch pocket and/or cure the pourable sealant, while also eliminating potential incompatibility issues (e.g., between any fill material and the pourable sealant) and the possible cracking of the cured sealant, which can create a leak issue. Accordingly, the insert of the current invention can promote a faster and easier method of installing a pitch pocket. In this regard, the insert, which is pre-made prior to installing into a pitch pocket, reduces the amount of time it takes to install a pitch pocket and the amount of pourable sealant needed to fill the pitch pocket. The insert can also reduce the curing time for the pourable sealant by reducing the time it takes the sealant to fully cure.

One embodiment of this invention pertains to an insert for a pitch pocket, with the insert comprising a first insert portion having an opening, and a second insert portion having an opening, wherein the first insert portion is configured to be positioned adjacent to the second insert portion in the pitch pocket, such that the opening of the first insert portion is positioned adjacent to the opening of the second insert portion in order to form a larger opening configured to receive a roof penetration.

FIG. 1A illustrates a pitch pocket according to an embodiment of the invention. In this embodiment, as shown in FIG. 1A, the pitch pocket 100 includes a base member 110 and an upward extending member 120, which extends upwardly from the base member 110. The upward extending member 120 extends from the base member 110 to a top edge 125, and defines an opening 130 (or pocket) configured to receive a pourable sealant.

Figure 1B:
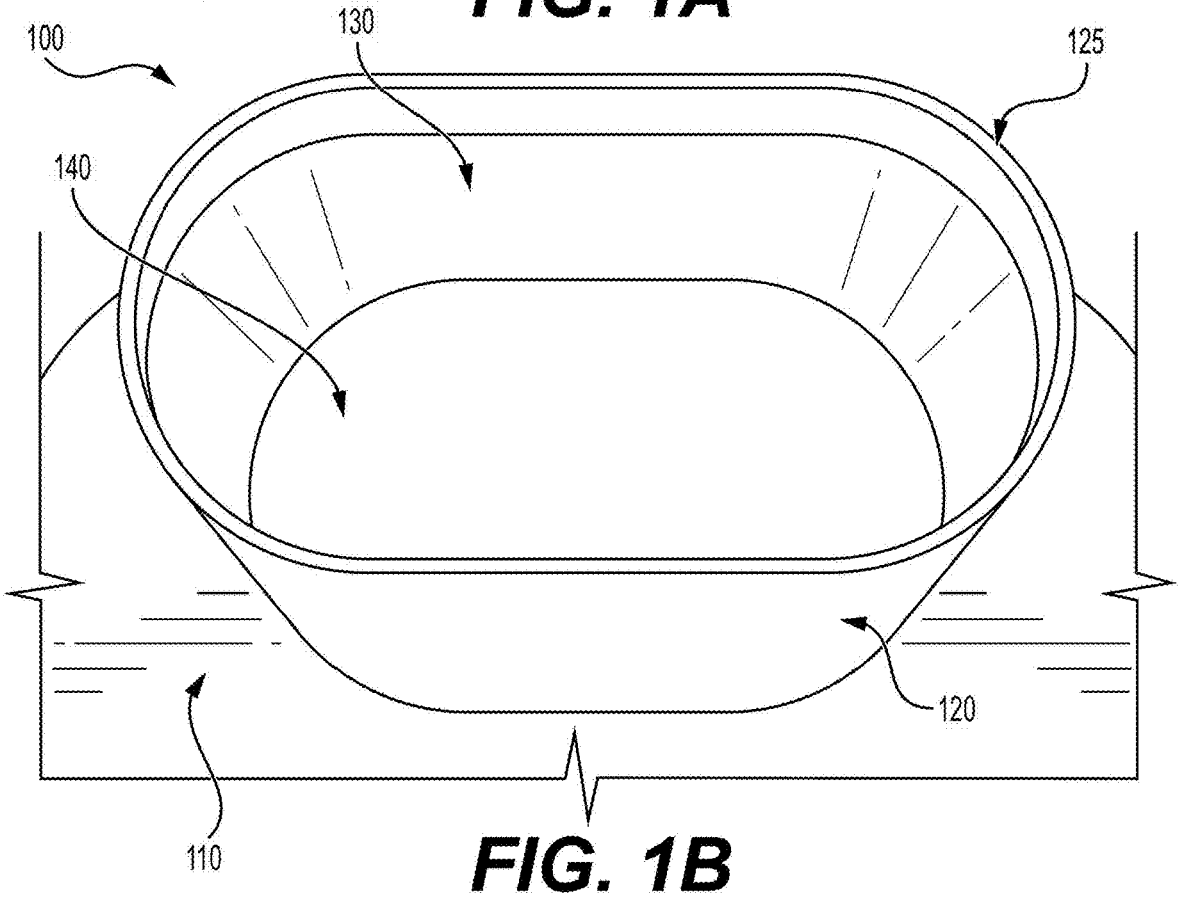
FIG. 1B is an illustration of a top view of the pitch pocket shown in FIG. 1A according to an embodiment of the invention.

FIG. 1B illustrates a top view of the pitch pocket 100 shown in FIG. 1A. As shown in FIG. 1B, the upward extending member 120 extends from the base member 110 to the top edge 125, and defines the opening 130 (or pocket) configured to receive a pourable sealant. The opening 130 (or pocket) defined by the upward extending member 120 extends from a bottom surface 140 of the opening 130 (or pocket) to the top edge 125 of the upward extending member 120.

Figure 2A:
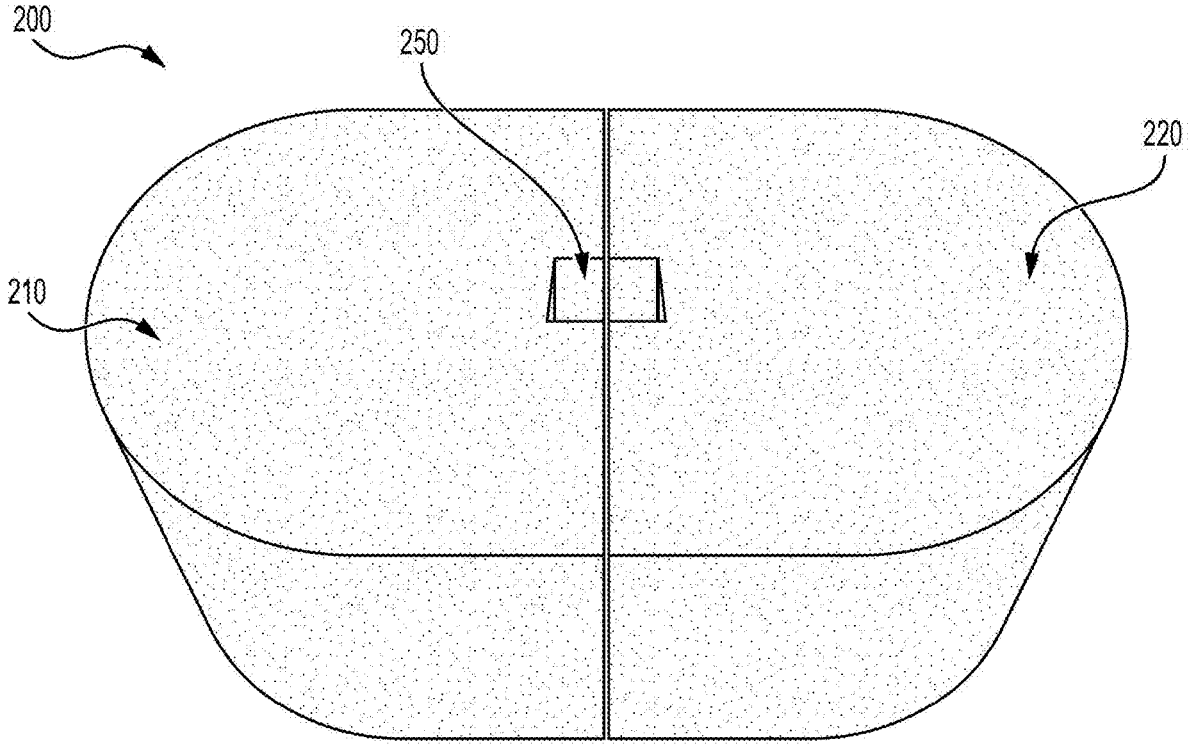
FIG. 2A is an illustration of an insert for a pitch pocket according to an embodiment of the invention.
Figure 2B:
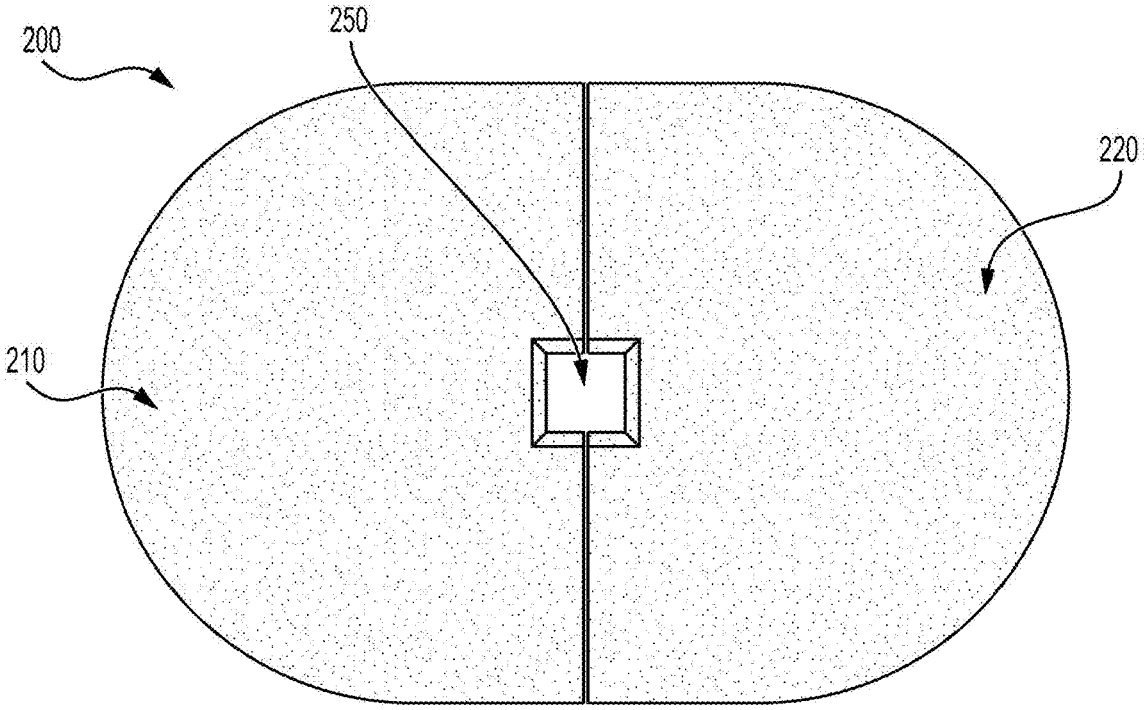
FIG. 2B is an illustration of a top view of the insert for a pitch pocket shown in FIG. 2A according to an embodiment of the invention.
Figure 2C:
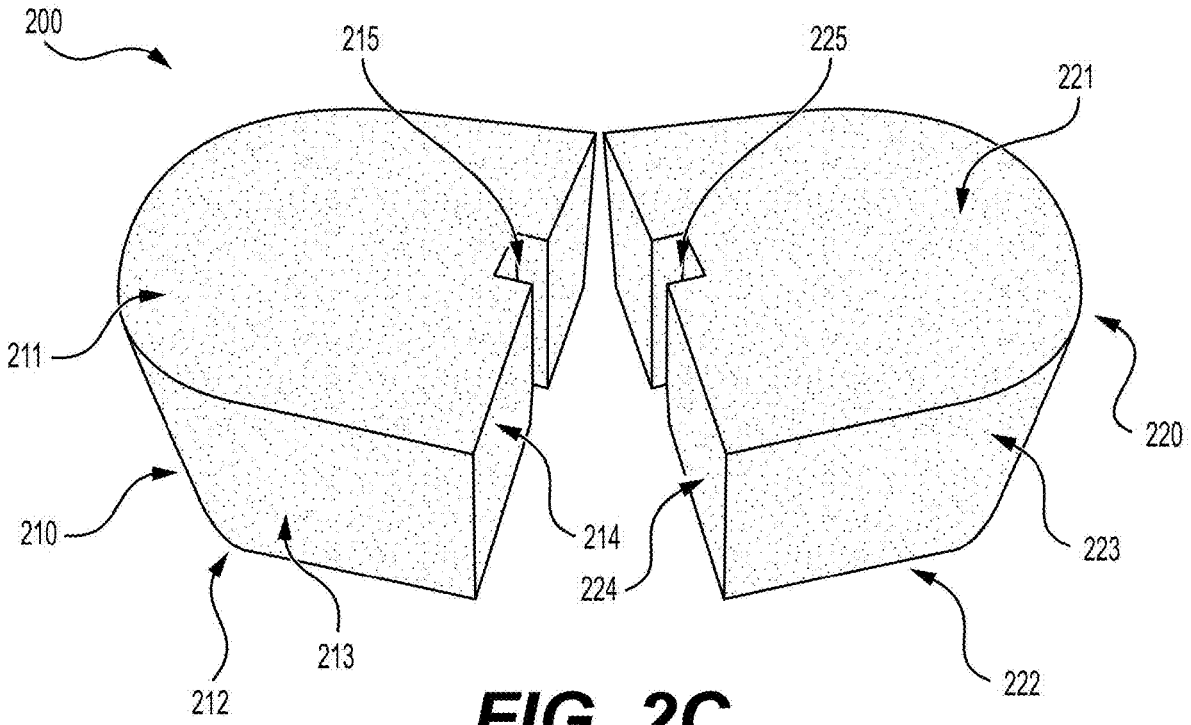
FIG. 2C is an illustration of the insert for a pitch pocket shown in FIG. 2A, with the two portions of the insert being positioned apart, according to an embodiment of the invention.

FIGS. 2A-2C illustrate an insert for a pitch pocket (see, e.g., pitch pocket 100 of FIGS. 1A and 1B) according to an embodiment of the invention. As shown in the embodiment of FIGS. 2A-2C, the insert 200 includes a first insert portion 210 having an opening 215, and a second insert portion 220 having an opening 225 (see, e.g., FIG. 2C), such that when the opening 215 of the first insert portion 210 is positioned adjacent to the opening 225 of the second insert portion 220, a larger opening 250 is formed in the insert 200, which is configured to receive a roof penetration (see, e.g., FIGS. 4 and 5). As shown in the embodiment of FIG. 2C, the first insert portion 210 of the insert 200 includes a top surface 211, a bottom surface 212, and a side wall 213 that extends from the top surface 211 to the bottom surface 212. As further shown in the embodiment of FIG. 2C, the second insert portion 220 of the insert 200 includes a top surface 221, a bottom surface 222, and a side wall 223 that extends from the top surface 221 to the bottom surface 222. As also shown in FIG. 2C, the first insert portion 210 includes a portion 214 of the side wall 213 that includes the opening 215, which is configured to be positioned adjacent to a portion 224 of the side wall 223 of the second insert portion 220 having the opening 225, in order for the opening 215 of the first insert portion 210 to be positioned adjacent to the opening 225 of the second insert portion 220 to thereby form the larger opening 250 (see, e.g., FIGS. 2A and 2B) configured to receive the roof penetration (see, e.g., FIGS. 4 and 5).

In one embodiment, the first insert portion and the second insert portion comprise a lightweight fully dried concrete material.

In one embodiment, the first insert portion and the second insert portion comprise a material receptive to a pourable sealant. By providing an insert with a first insert portion and a second insert portion that comprise a material receptive to a pourable sealant, good adhesion can be ensured among all of the components of a pitch pocket system, e.g., the pitch pocket, the insert, and the pourable sealant.

In one embodiment, (i) the opening of the first insert portion is from 1 inches to 6 inches in diameter, and (ii) the opening of the second insert portion is from 1 inches to 6 inches in diameter. In one embodiment, (i) the opening of the first insert portion is from 2 inches to 6 inches in diameter, and (ii) the opening of the second insert portion is from 2 inches to 6 inches in diameter. In one embodiment, (i) the opening of the first insert portion is from 3 inches to 6 inches in diameter, and (ii) the opening of the second insert portion is from 3 inches to 6 inches in diameter. In one embodiment, (i) the opening of the first insert portion is from 4 inches to 6 inches in diameter, and (ii) the opening of the second insert portion is from 4 inches to 6 inches in diameter. In one embodiment, (i) the opening of the first insert portion is from 5 inches to 6 inches in diameter, and (ii) the opening of the second insert portion is from 5 inches to 6 inches in diameter.

In one embodiment, (i) the opening of the first insert portion is from 4 1/16 inches to 5 1/16 inches in diameter, and (ii) the opening of the second insert portion is from 4 1/16 inches to 5 1/16 inches in diameter. In one embodiment, (i) the opening of the first insert portion is from 4 1/8 inches to 5 1/16 inches in diameter, and (ii) the opening of the second insert portion is from 4 1/8 inches to 5 1/16 inches in diameter. In one embodiment, (i) the opening of the first insert portion is from 4 3/16 inches to 5 1/16 inches in diameter, and (ii) the opening of the second insert portion is from 4 3/16 inches to 5 1/16 inches in diameter. In one embodiment, (i) the opening of the first insert portion is from 4 1/4 inches to 5 1/16 inches in diameter, and (ii) the opening of the second insert portion is from 4 1/4 inches to 5 1/16 inches in diameter. In one embodiment, (i) the opening of the first insert portion is from 4 5/16 inches to 5 1/16 inches in diameter, and (ii) the opening of the second insert portion is from 4 5/16 inches to 5 1/16 inches in diameter. In one embodiment, (i) the opening of the first insert portion is from 4 3/8 inches to 5 1/16 inches in diameter, and (ii) the opening of the second insert portion is from 4 3/8 inches to 5 1/16 inches in diameter. In one embodiment, (i) the opening of the first insert portion is from 4 7/16 inches to 5 1/16 inches in diameter, and (ii) the opening of the second insert portion is from 4 7/16 inches to 5 1/16 inches in diameter. In one embodiment, (i) the opening of the first insert portion is from 4 1/2 inches to 5 1/16 inches in diameter, and (ii) the opening of the second insert portion is from 4 1/2 inches to 5 1/16 inches in diameter. In one embodiment, (i) the opening of the first insert portion is from 4 9/16 inches to 5 1/16 inches in diameter, and (ii) the opening of the second insert portion is from 4 9/16 inches to 5 1/16 inches in diameter. In one embodiment, (i) the opening of the first insert portion is from 4 5/8 inches to 5 1/16 inches in diameter, and (ii) the opening of the second insert portion is from 4 5/8 inches to 5 1/16 inches in diameter. In one embodiment, (i) the opening of the first insert portion is from 4 11/16 inches to 5 1/16 inches in diameter, and (ii) the opening of the second insert portion is from 4 11/16 inches to 5 1/16 inches in diameter. In one embodiment, (i) the opening of the first insert portion is from 4 3/4 inches to 5 1/16 inches in diameter, and (ii) the opening of the second insert portion is from 4 3/4 inches to 5 1/16 inches in diameter. In one embodiment, (i) the opening of the first insert portion is from 4 13/16 inches to 5 1/16 inches in diameter, and (ii) the opening of the second insert portion is from 4 13/16 inches to 5 1/16 inches in diameter. In one embodiment, (i) the opening of the first insert portion is from 4 7/8 inches to 5 1/16 inches in diameter, and (ii) the opening of the second insert portion is from 4 7/8 inches to 5 1/16 inches in diameter. In one embodiment, (i) the opening of the first insert portion is from 4 15/16 inches to 5 1/16 inches in diameter, and (ii) the opening of the second insert portion is from 4 15/16 inches to 5 1/16 inches in diameter. In one embodiment, (i) the opening of the first insert portion is from 5 inches to 5 1/16 inches in diameter, and (ii) the opening of the second insert portion is from 5 inches to 5 1/16 inches in diameter.

In one embodiment, (i) the opening of the first insert portion is from 4 inches to 5 inches in diameter, and (ii) the opening of the second insert portion is from 4 inches to 5 inches in diameter. In one embodiment, (i) the opening of the first insert portion is 4 1/2 inches in diameter, and (ii) the opening of the second insert portion is 4 1/2 inches in diameter. In one embodiment, (i) the opening of the first insert portion is 4 3/8 inches in diameter, and (ii) the opening of the second insert portion is 4 3/8 inches in diameter.

In one embodiment, the first insert portion is substantially the same size as the second insert portion. By creating an insert that comprises two equally designed halves (i.e., the first insert portion is the same design as the second insert portion), customers and/or contractors can insert the two halves of the insert into a pitch pocket and around a roof penetration (e.g., an electrical cable, various types/sizes of pipes, etc.), which thereby creates a seal against the interior surface of the pitch pocket and the roof penetration.

Figure 2D:
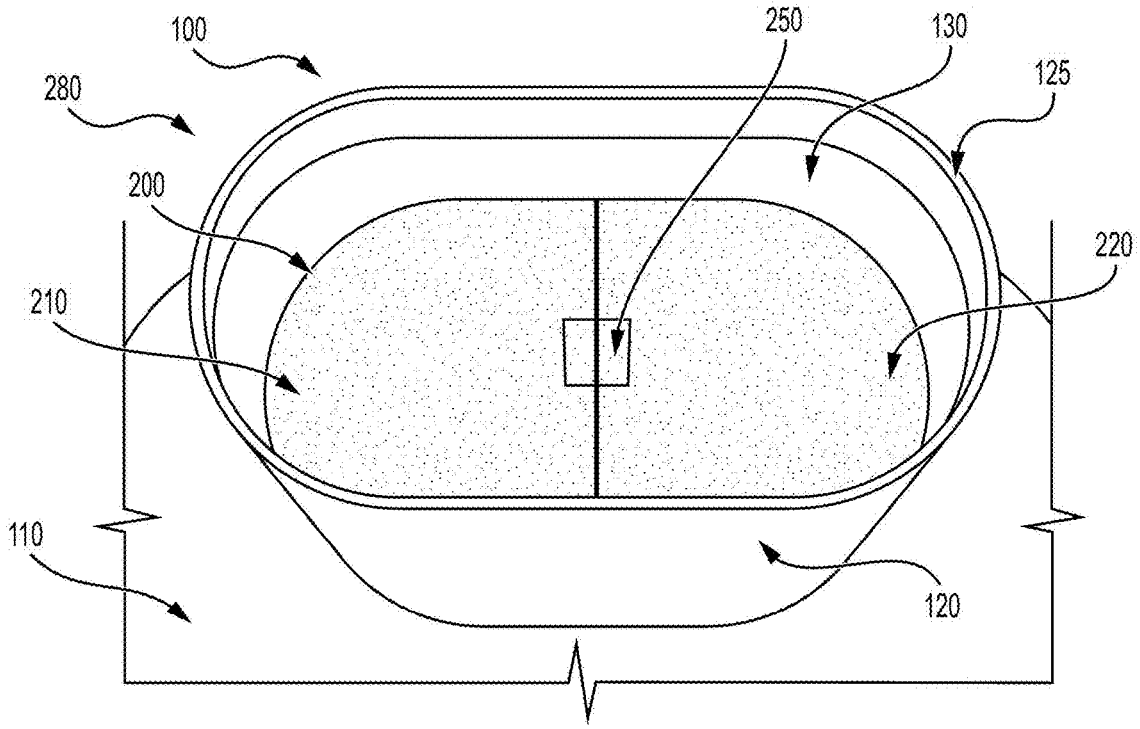
FIG. 2D is an illustration of a pitch pocket system that includes the insert for a pitch pocket shown in FIG. 2A, with the insert being positioned within the pitch pocket shown in FIGS. 1A and 1B, according to an embodiment of the invention.

Another embodiment of this invention pertains to a pitch pocket system comprising (a) a pitch pocket and (b) an insert positioned within the pitch pocket, wherein the insert comprises an opening configured to receive a roof penetration. FIG. 2D illustrates a pitch pocket system 280, which includes the insert 200 for a pitch pocket shown in FIGS. 2A-2C, with the insert 200 being positioned within the pitch pocket 100 shown in FIGS. 1A and 1B, according to an embodiment of the invention. As shown in FIG. 2D, the insert 200 is positioned within the opening 130 (or pocket) defined by the upward extending member 120 of the pitch pocket 100 that extends from a bottom surface (not shown) of the opening 130 (or pocket) to the top edge 125 of the upward extending member 120. As further shown in FIG. 2D, the larger opening 250 of the insert 200, which is defined by the opening 215 of the first insert portion 210 being positioned adjacent to the opening 225 of the second insert portion 220, is generally positioned within the center of the pitch pocket 100 in order to receive a roof penetration (not shown) therethrough (see, e.g., FIGS. 4 and 5).

In one embodiment, the pitch pocket comprises thermoplastic polyolefin (e.g., a TPO membrane).

In one embodiment, the opening of the insert is from 5 inches to 10 inches in diameter. In one embodiment, the opening of the insert is from 6 inches to 10 inches in diameter. In one embodiment, the opening of the insert is from 7 inches to 10 inches in diameter. In one embodiment, the opening of the insert is from 8 inches to 10 inches in diameter. In one embodiment, the opening of the insert is from 9 inches to 10 inches in diameter. In one embodiment, the opening of the insert is from 5 inches to 9 inches in diameter. In one embodiment, the opening of the insert is from 6 inches to 9 inches in diameter. In one embodiment, the opening of the insert is from 7 inches to 9 inches in diameter. In one embodiment, the opening of the insert is from 8 inches to 9 inches in diameter. In one embodiment, the opening of the insert is from 8 1/2 inches to 9 inches in diameter.

In one embodiment, the opening of the insert is from 8 1/8 inches to 8 7/8 inches in diameter. In one embodiment, the opening of the insert is from 8 1/4 inches to 8 7/8 inches in diameter. In one embodiment, the opening of the insert is from 8 3/8 inches to 8 7/8 inches in diameter. In one embodiment, the opening of the insert is from 8 1/2 inches to 8 7/8 inches in diameter. In one embodiment, the opening of the insert is from 8 5/8 inches to 8 7/8 inches in diameter. In one embodiment, the opening of the insert is from 8 3/4 inches to 8 7/8 inches in diameter.

In one embodiment, the opening of the insert is 8 1/4 inches in diameter. In one embodiment, the opening of the insert is 8 1/2 inches in diameter. In one embodiment, the opening of the insert is 8 3/4 inches in diameter. In one embodiment, the opening of the insert is 9 inches in diameter.

Figure 3A:
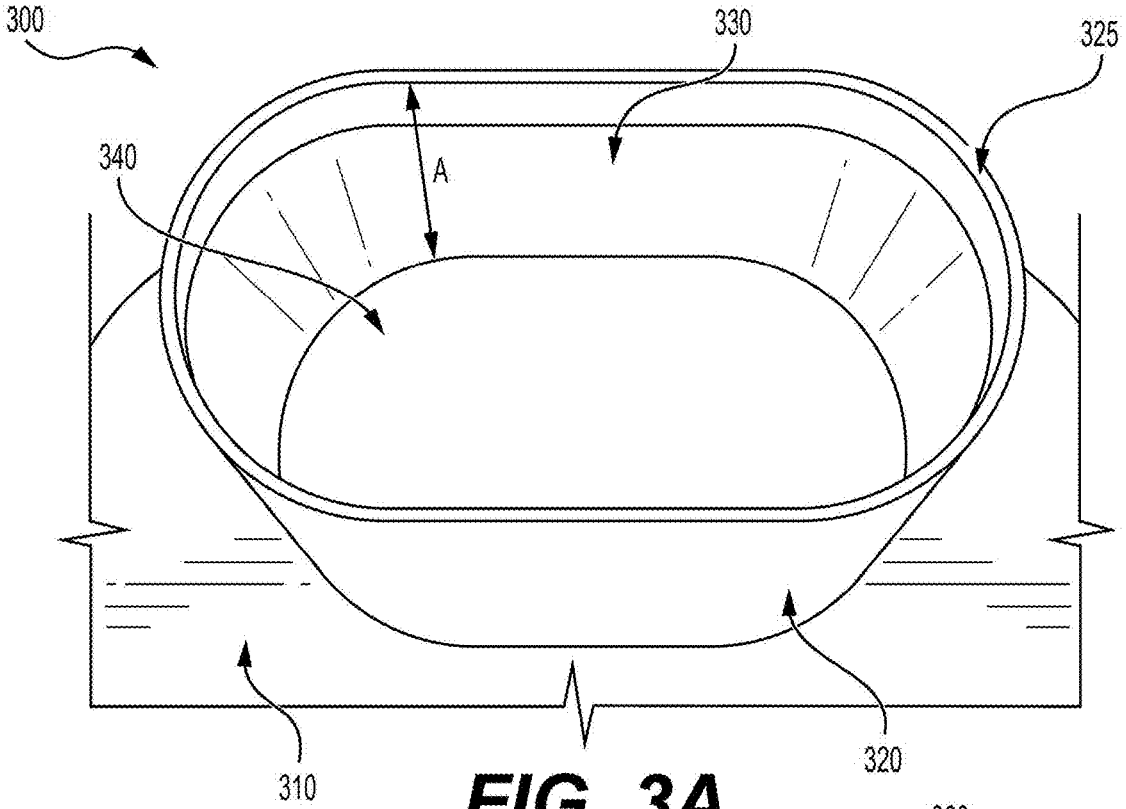
FIG. 3A is an illustration of a top view of a pitch pocket according to an embodiment of the invention (see also, e.g., FIG. 1B).
Figure 3B:
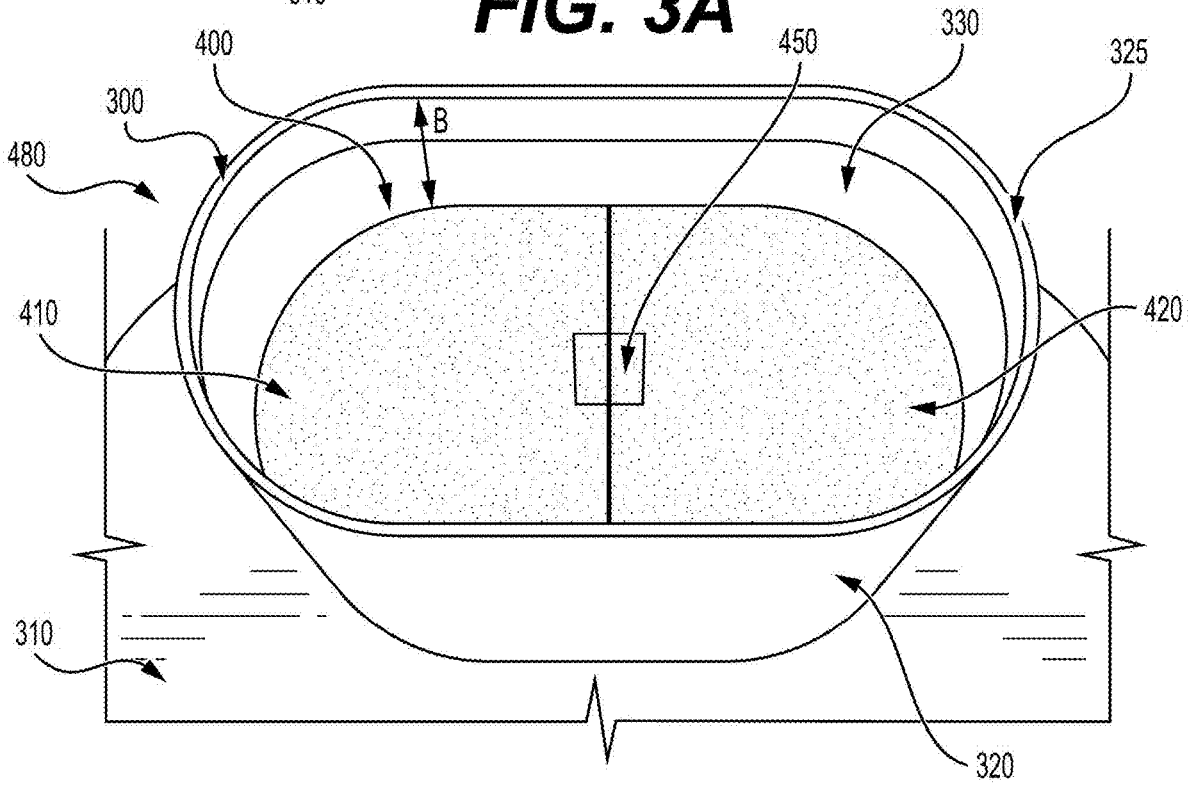
FIG. 3B is an illustration of the pitch pocket shown in FIG. 3A with an insert positioned within the pitch pocket according to an embodiment of the invention (see also, e.g., FIG. 2D).

FIG. 3A illustrates a pitch pocket prior to an insert being included within the opening (or pocket) of the pitch pocket, while FIG. 3B illustrates a pitch pocket system, which includes an insert for a pitch pocket, with the insert being positioned within the pitch pocket shown in FIG. 3A, according to an embodiment of the invention. As shown in the embodiment of FIG. 3A, the pitch pocket 300 includes a base member 310 and an upward extending member 320, which extends upwardly from the base member 310. The upward extending member 320 extends from the base member 310 to a top edge 325, and defines an opening 330 (or pocket) configured to receive a pourable sealant. As further shown in FIG. 3A, the opening 330 (or pocket) defined by the upward extending member 320 extends from a bottom surface 340 of the opening 330 (or pocket) to the top edge 325 of the upward extending member 320. As also shown in the embodiment of FIG. 3A, a height (A) is illustrated, which is the height (A) of the opening 330 (or pocket) from the bottom surface 340 of the opening 330 (or pocket) to the top edge 325 of the upward extending member 320. According to one embodiment, this height (A), which is also considered the "fill area" for the pitch pocket 300, is generally around 4" to 5".

As discussed above, FIG. 3B illustrates a pitch pocket system 480, which includes an insert for a pitch pocket, with the insert being positioned within the pitch pocket 300 shown in FIG. 3A, according to an embodiment of the invention. As shown in FIG. 3B, an insert 400, which comprises a first insert portion 410 positioned adjacent to a second insert portion 420, is positioned within the opening 330 (or pocket) defined by the upward extending member 320 of the pitch pocket 300 that extends from a bottom surface (not shown) of the opening 330 (or pocket) to the top edge 325 of the upward extending member 320. As further shown in FIG. 3B, a larger opening 450 of the insert 400, which is defined by an opening of the first insert portion 410 being positioned adjacent to an opening of the second insert portion 420, is generally positioned within the center of the pitch pocket 300 in order to receive a roof penetration (not shown) therethrough (see, e.g., FIGS. 4 and 5). As also shown in the embodiment of FIG. 3B, a height (B) is illustrated, which is the height (B) that the insert 400, which includes the first insert portion 410 and the second insert portion 420, fills the opening 330 (or pocket) of the pitch pocket 300. According to one embodiment, this height (B), which is also considered the new fill area into which a pourable sealant can be added, is generally around 2 inches to 3 inches from the top edge 325 of the pitch pocket.

In one embodiment, the first insert portion and the second insert portion of the insert are configured to fill the pitch pocket to a first height. In one embodiment, the first height is from 1 inch to 3 inches from a top edge of the pitch pocket. In one embodiment, the first height is from 2 inches to 3 inches from a top edge of the pitch pocket. In one embodiment, the first height is from 2⅛ inches to 3 inches from a top edge of the pitch pocket. In one embodiment, the first height is from 2¼ inches to 3 inches from a top edge of the pitch pocket. In one embodiment, the first height is from 2⅜ inches to 3 inches from a top edge of the pitch pocket. In one embodiment, the first height is from 2½ inches to 3 inches from a top edge of the pitch pocket. In one embodiment, the first height is from 2⅝ inches to 3 inches from a top edge of the pitch pocket. In one embodiment, the first height is from 2¾ inches to 3 inches from a top edge of the pitch pocket. In one embodiment, the first height is from 2⅞ inches to 3 inches from a top edge of the pitch pocket.

In one embodiment, the first height is from 2⅛ inches to 2⅝ inches from a top edge of the pitch pocket. In one embodiment, the first height is from 2¼ inches to 2⅝ inches from a top edge of the pitch pocket. In one embodiment, the first height is from 2⅜ inches to 2⅝ inches from a top edge of the pitch pocket. In one embodiment, the first height is from 2½ inches to 2⅝ inches from a top edge of the pitch pocket. In one embodiment, the first height is 2½ inches from a top edge of the pitch pocket.

Figure 4:
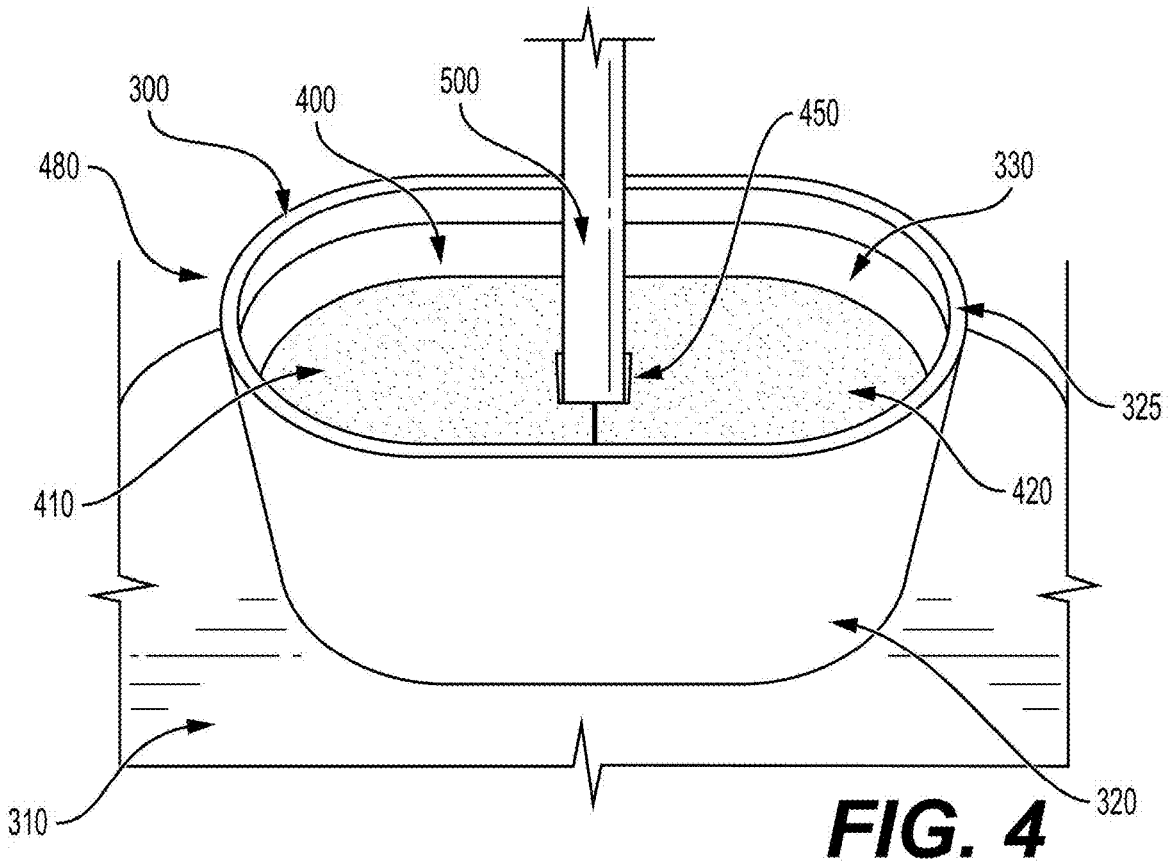
FIG. 4 is an illustration of the pitch pocket with the insert positioned therein, as shown in FIG. 3B, being positioned around an electrical conduit according to an embodiment of the invention.

FIG. 4 illustrates the pitch pocket system 480, as shown in FIG. 3B, which comprises the pitch pocket 300 of FIG. 3A with the insert 400 being positioned therein, with the pitch pocket system 480 being positioned around an electrical conduit according to an embodiment of the invention. As shown in the embodiment of FIG. 4, the insert 400, which comprises the first insert portion 410 positioned adjacent to the second insert portion 420, is positioned within the opening 330 (or pocket) defined by the upward extending member 320 of the pitch pocket 300 that extends from a bottom surface (not shown) of the opening 330 (or pocket) to the top edge 325 of the upward extending member 320. As further shown in FIG. 4, an electrical conduit 500 extends through the larger opening 450 of the insert 400, which is defined by an opening of the first insert portion 410 being positioned adjacent to an opening of the second insert portion 420.

Figure 5:
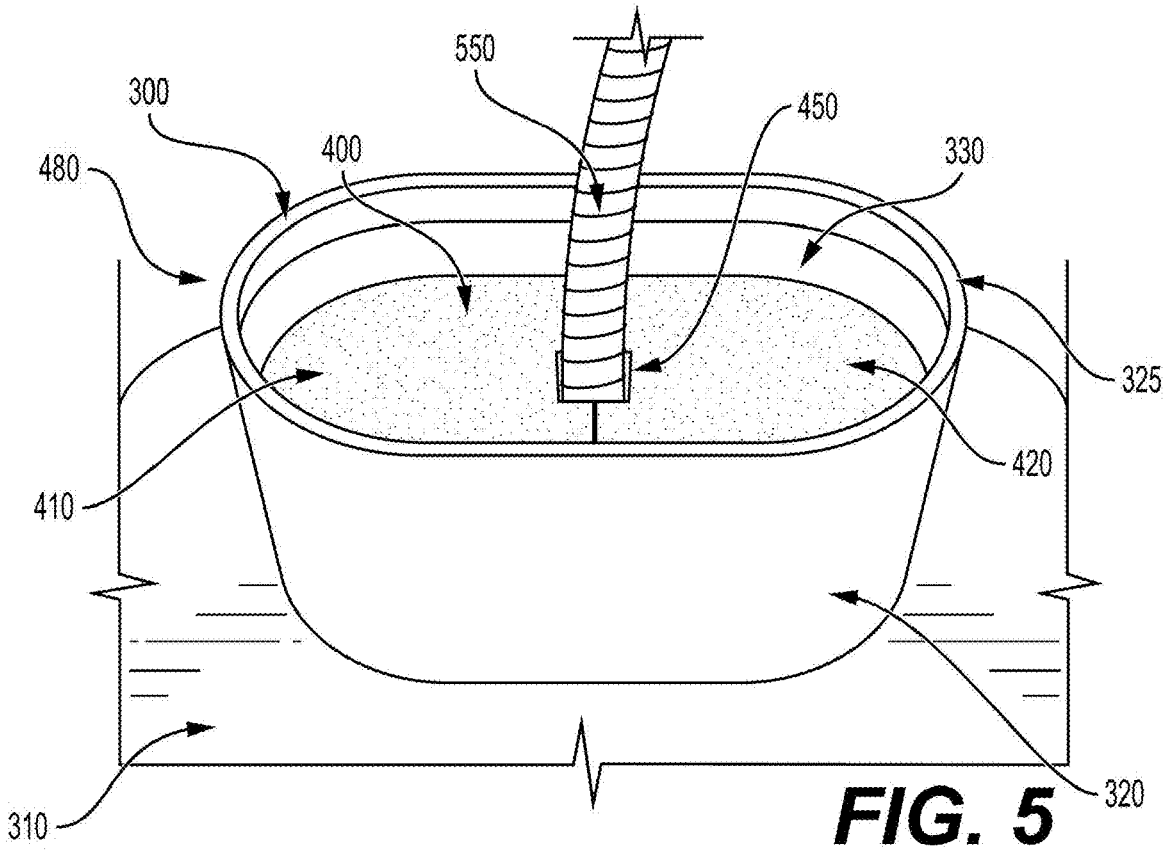
FIG. 5 is an illustration of the pitch pocket with the insert positioned therein, as shown in FIG. 3B, being positioned around an electrical SEALTITE® cable according to an embodiment of the invention.

FIG. 5 illustrates the pitch pocket system 480, as shown in FIG. 3B, which comprises the pitch pocket 300 of FIG. 3A with the insert 400 being positioned therein, with the pitch pocket system 480 being positioned around an electrical SEALTITE® cable according to an embodiment of the invention. As shown in the embodiment of FIG. 5, the insert 400, which comprises the first insert portion 410 positioned adjacent to the second insert portion 420, is positioned within the opening 330 (or pocket) defined by the upward extending member 320 of the pitch pocket 300 that extends from a bottom surface (not shown) of the opening 330 (or pocket) to the top edge 325 of the upward extending member 320. As further shown in FIG. 5, an electrical SEALTITE® cable 550 extends through the larger opening 450 of the insert 400, which is defined by an opening of the first insert portion 410 being positioned adjacent to an opening of the second insert portion 420.

In one embodiment, the roof penetration comprises one of an electrical conduit, an electrical cable, a vent, a pipe, or a support member.

Another embodiment of this invention pertains to a pitch pocket kit that includes (a) a pitch pocket, (b) a first insert portion having an opening, (c) a second insert portion having an opening, and (d) instructions for installation of the pitch pocket around a roof penetration, wherein the first insert portion is configured to be positioned adjacent to the second insert portion in the pitch pocket, such that the opening of the first insert portion is positioned adjacent to the opening of the second insert portion in order to form a larger opening configured to receive the roof penetration.

In one embodiment, the pitch pocket kit further comprises a pourable sealant. In one embodiment, the pourable sealant comprises a pourable TPO sealant.

Another embodiment of this invention pertains to a method for installing a pitch pocket around a roof penetration, with the method comprising (a) obtaining a pitch pocket, (b) obtaining a first insert portion having an opening, (c) obtaining a second insert portion having an opening, (d) positioning the pitch pocket around the roof penetration, (e) inserting the first insert portion and the second insert portion into the pitch pocket, such that the opening of the first insert portion is positioned adjacent to the opening of the second insert portion in order to form a larger opening that surrounds the roof penetration, and (f) pouring a sealant on top of the first insert portion and the second insert portion inserted into the pitch pocket to thereby seal the pitch pocket around the roof penetration.

In one embodiment, the method includes applying a primer on top of the first insert portion and the second insert portion inserted into the pitch pocket prior to pouring the sealant.

In one embodiment, the inserting of the first insert portion and the second insert portion is conducted to fill the pitch pocket to a height that is from 1 inch to 3 inches from a top edge of the pitch pocket. In one embodiment, the inserting of the first insert portion and the second insert portion is conducted to fill the pitch pocket to a height that is from 2 inches to 3 inches from a top edge of the pitch pocket. In one embodiment, the inserting of the first insert portion and the second insert portion is conducted to fill the pitch pocket to a height that is from 2⅛ inches to 3 inches from a top edge of the pitch pocket. In one embodiment, the inserting of the first insert portion and the second insert portion is conducted to fill the pitch pocket to a height that is from 2¼ inches to 3 inches from a top edge of the pitch pocket. In one embodiment, the inserting of the first insert portion and the second insert portion is conducted to fill the pitch pocket to a height that is from 2⅜ inches to 3 inches from a top edge of the pitch pocket. In one embodiment, the inserting of the first insert portion and the second insert portion is conducted to fill the pitch pocket to a height that is from 2½ inches to 3 inches from a top edge of the pitch pocket. In one embodiment, the inserting of the first insert portion and the second insert portion is conducted to fill the pitch pocket to a height that is from 2⅝ inches to 3 inches from a top edge of the pitch pocket. In one embodiment, the inserting of the first insert portion and the second insert portion is conducted to fill the pitch pocket to a height that is from 2¾ inches to 3 inches from a top edge of the pitch pocket. In one embodiment, the inserting of the first insert portion and the second insert portion is conducted to fill the pitch pocket to a height that is from 2⅞ inches to 3 inches from a top edge of the pitch pocket.

In one embodiment, the inserting of the first insert portion and the second insert portion is conducted to fill the pitch pocket to a height that is from 2⅛ inches to 2⅝ inches from a top edge of the pitch pocket. In one embodiment, the inserting of the first insert portion and the second insert portion is conducted to fill the pitch pocket to a height that is from 2¼ inches to 2⅝ inches from a top edge of the pitch pocket. In one embodiment, the inserting of the first insert portion and the second insert portion is conducted to fill the pitch pocket to a height that is from 2⅜ inches to 2⅝ inches from a top edge of the pitch pocket. In one embodiment, the inserting of the first insert portion and the second insert portion is conducted to fill the pitch pocket to a height that is from 2½ inches to 2⅝ inches from a top edge of the pitch pocket. In one embodiment, the inserting of the first insert portion and the second insert portion is conducted to fill the pitch pocket to a height that is 2½ inches from a top edge of the pitch pocket.

According to embodiments of the invention described herein, an insert for a pitch pocket is provided that can provide an easy and consistent way of filling the excess void or opening of a pitch pocket (i.e., a pourable sealer pocket) that is generally filled with a pourable sealant. This thereby removes the need for customers and/or contractors to scavenge around for any kind of material (e.g., filler material) to use to reduce the amount of pourable sealant needed to fill the pitch pocket. For example, without a filler material, it takes approximately 1.5 to 2 pouches of pourable sealant to fill the pitch pocket. However, according to embodiments of the invention described herein, the insert for a pitch pocket of the current invention could reduce the amount of pourable sealant needed to fill the pitch pocket, such that only ½ to ¾ of a pouch of pourable sealant is needed to fill the pitch pocket having the insert positioned therein.

According to embodiments of the invention described herein, an insert for a pitch pocket is provided, with the insert being pre-made, and the insert being capable of increasing the overall performance of the pitch pocket (e.g., by preventing leaks) and reducing the amount of pourable sealant needed to fill and seal the pitch pocket. Moreover, the installation time of each pitch pocket can be reduced, which will save customers and/or contractors labor cost and/or overall material costs by using less material (e.g., pourable sealant).

Although the invention has been described in certain specific exemplary embodiments, many additional modifications and variations would be apparent to those skilled in the art in light of this disclosure. It is, therefore, to be understood that this invention may be practiced otherwise than as specifically described. Thus, the exemplary embodiments of the invention should be considered in all respects to be illustrative and not restrictive, and the scope of the invention to be determined by any claims supportable by this application and the equivalents thereof, rather than by the foregoing description.

The invention claimed is:

1. A pitch pocket system comprising:

a pitch pocket comprising a unitary member having a base member and an upwardly extending member that extends upwardly from the base member to a top edge that defines an opening; and an insert positioned within the opening of the pitch pocket, the insert comprising a top surface, a bottom surface, and a side wall that extends from the top surface to the bottom surface, wherein the insert comprises an opening configured to receive a roof penetration, wherein the insert comprises a concrete material that fills the pitch pocket to a first height, with the top surface of the insert being adapted to receive a pourable sealant, and wherein the roof penetration comprises one of an electrical conduit, an electrical cable, a vent, a pipe, or a support member.

2. The pitch pocket system according to claim 1, wherein the insert comprises a lightweight fully dried concrete material that is receptive to the pourable sealant.

3. The pitch pocket system according to claim 1, wherein the insert comprises (i) a first insert portion having an opening and (ii) a second insert portion having an opening.

4. The pitch pocket system according to claim 1, wherein the pitch pocket comprises thermoplastic polyolefin.

5. The pitch pocket system according to claim 1, wherein the opening of the insert is from 8 inches to 9 inches in diameter.

6. The pitch pocket system according to claim 1, wherein the insert fills the pitch pocket to a height that is from 2 inches to 3 inches from the top edge of the pitch pocket.

7. A pitch pocket kit comprising:

a pitch pocket comprising a unitary member having a base member and an upwardly extending member that extends upwardly from the base member to a top edge that defines an opening;

a first insert portion comprising a top surface, a bottom surface, and a side wall that extends from the top surface to the bottom surface, the first insert portion having an opening;

a second insert portion comprising a top surface, a bottom surface, and a side wall that extends from the top surface to the bottom surface, the second insert portion having an opening; and instructions for installation of the pitch pocket around a roof penetration, wherein the first insert portion is configured to be positioned adjacent to the second insert portion in the opening of the pitch pocket, such that each of the first insert portion and the second insert portion comprises a concrete material that fills the pitch pocket to a first height and the opening of the first insert portion is positioned adjacent to the opening of the second insert portion in order to form a larger opening configured to receive the roof penetration, and wherein the roof penetration comprises one of an electrical conduit, an electrical cable, a vent, a pipe, or a support member.

8. The pitch pocket kit according to claim 7, wherein the first insert portion and the second insert portion comprise a lightweight fully dried concrete material.

9. The pitch pocket kit according to claim 7, wherein the top surface of each of the first insert portion and the second insert portion is adapted to receive a pourable sealant.

10. The pitch pocket kit according to claim 7, further comprising a pourable sealant.

11. The pitch pocket kit according to claim 7, wherein the pitch pocket comprises thermoplastic polyolefin.

* * * * *